United States Patent [19]

Auchapt et al.

[11] Patent Number: 4,504,524

[45] Date of Patent: Mar. 12, 1985

[54] PROCESS FOR THE REMOTE COATING OF THE SURFACES OF A CAVITY, AS WELL AS THE APPLICATION OF THIS PROCESS

[75] Inventors: Pierre R. Auchapt, Bagnols; Aimé J. Ferlay, Laudun, both of France

[73] Assignee: Commissariat a l'Energie Atomique, Paris, France

[21] Appl. No.: 447,656

[22] Filed: Dec. 7, 1982

[30] Foreign Application Priority Data

Dec. 24, 1981 [FR] France ..... 81 24221

[51] Int. Cl.[3] ..... B05D 7/22

[52] U.S. Cl. ..... 427/230; 427/238

[58] Field of Search ..... 427/230, 237, 238, 239, 427/203, 350, 331

[56] References Cited

U.S. PATENT DOCUMENTS 3,647,521 3/1972 Tulin ..... 427/238
3,661,621 5/1972 Jager ..... 427/238
3,669,721 6/1972 Jager ..... 427/238
3,740,251 6/1973 Repsher ..... 427/237

FOREIGN PATENT DOCUMENTS 57-21395 5/1982 Japan ..... 427/230

*Primary Examiner*—S. L. Childs
*Attorney, Agent, or Firm*—Dennis P. Clarke

[57] ABSTRACT

A process for remotely fixing toxic dust, such as plutonium oxide, on the surfaces of a sealed cavity defining an airlock between two enclosures containing toxic material which are sealingly coupled to each other, so as to avoid contamination of the atmosphere upon uncoupling of the enclosures. The cavity is filled through an inlet zone with a solution of silicone grease in a solvent, such as freon, which is capable of wetting the surfaces of the cavity. The solvent is vaporized and evacuated from the cavity such that the silicone grease is deposited on the surfaces of the cavity to fix the toxic dust thereto.

4 Claims, 1 Drawing Figure

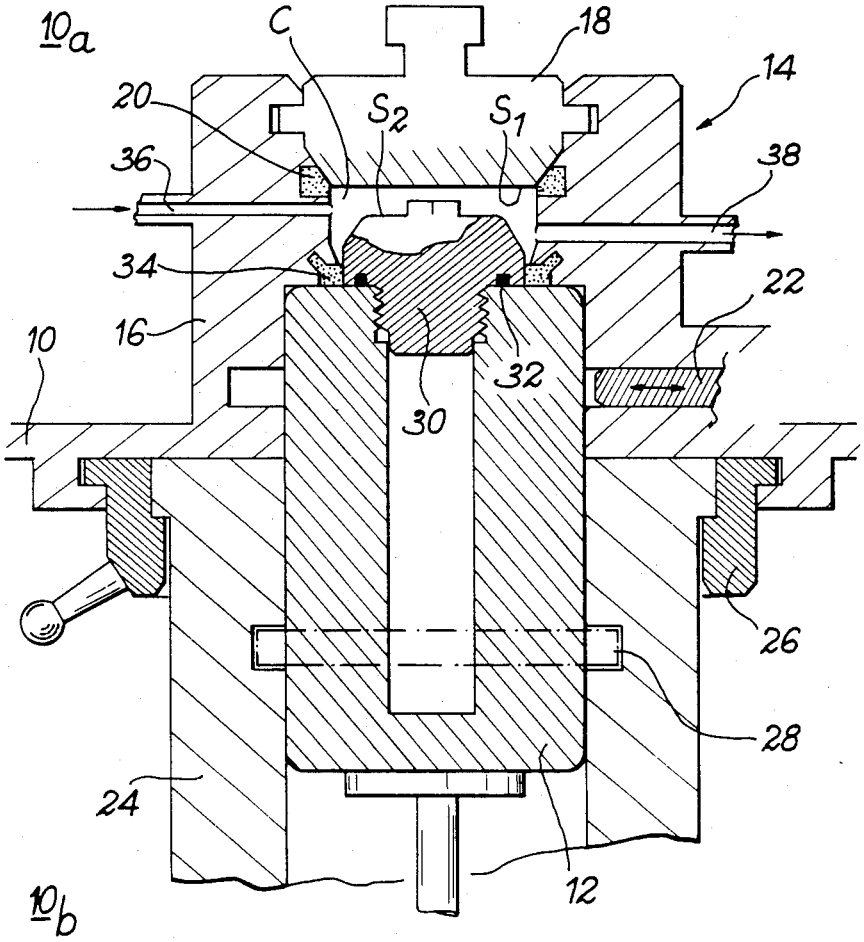
10a
C
18
14
20
S2
S1
36
38
34
22
10
16
32
30
26
28
24
12
10b

PROCESS FOR THE REMOTE COATING OF THE SURFACES OF A CAVITY, AS WELL AS THE APPLICATION OF THIS PROCESS

BACKGROUND OF THE INVENTION

The present invention relates to a process for the remote coating of the surfaces of a cavity with the aid of a product, which can adhere to the surfaces, as well as to the application of this process to fixing toxic dust to the walls of a cavity defined between the plugs of two tight enclosures containing toxic products and prior to the uncoupling of these enclosures.

In certain cases, it may be desirable to coat the surfaces of a cavity with the aid of a film of a given product, without it being possible to have direct access to this surface.

As a non-limitative example, reference is made to the case of a cavity contaminated by a toxic product, such as a radioactive product and which must be decontaminated before being brought into contact with the atmosphere. This is particularly the case with the cavity defined between the plug of a container for transporting toxic products and the plug of a filling or emptying enclosure, after the top of the container has been coupled to the enclosure. Thus, even if this cavity can be decontaminated by circulating freon at high speed therein or which is ultrasonically stirred therein, in accordance with French Pat. No. 2,352,377 of May 21st 1976, residual contamination is still left behind on the walls in the form of toxic dust and according to the present invention it is advantageous to fix this dust by means of a film of an adequate product, in order to prevent the dispersion thereof into the atmosphere.

BRIEF SUMMARY OF THE INVENTION

The present invention relates to a process for the remote coating of surfaces, such as the surfaces of the cavity formed between the plugs of an enclosure and a container containing toxic products before they are uncoupled and said surfaces come into contact with the atmosphere. However, the invention also relates to a process for the remote coating of any surfaces placed in a sealed cavity, with the aid of a product which can adhere to these surfaces.

The present invention therefore proposes a process comprising the stages of dissolving the product in a solvent able to wet the surface, filling the cavity with the aid of the thus formed solution, vaporizing the solvent and removing the vaporized solvent from the cavity.

Solvent vaporization can be brought about either by producing a vacuum, or by circulating air within the cavity.

In the application of this process to the fixing to toxic dust on the walls of a cavity defined between the plugs of two tight enclosures containing a toxic atmosphere, prior to the uncoupling of said enclosures, the product used is preferably constituted by a silicone grease and the solvent is preferably constituted by freon.

DESCRIPTION OF THE DRAWING AND PREFERRED EMBODIMENT

The invention is described in greater detail hereinafter relative to a non-limitative embodiment and with reference to the attached drawing, which is a sectional view of the top of a container coupled to an enclosure for filling or emptying said container.

The drawing shows part of the wall 10 of an enclosure containing a toxic product and in particular a radioactive product with a high contaminating power, such as plutonium oxide in powder form. This enclosure can either be an enclosure in which the product is prepared, or a storage enclosure, or an enclosure in which the product is treated. Enclosure wall 10 separates the internal contaminated zone 10*a* from the external inactive zone 10*b*. Whatever the function of the enclosure, it is necessary to provide means for ensuring the introduction or removal of the product with respect to a container 12, permitting its transfer between two enclosures, such as a storage enclosure and a treatment enclosure. These means are constituted by a lock chamber means 14 comprising a cylindrical ferrule 16 sealingly fixed to the enclosure 10 and a plug 18 tightly sealing e.g. by means of a joint 20, the end of ferrule 16 placed in enclosure 10. The other end of ferrule 16 is normally closed by a cover 22, when no container is coupled to enclosure 10. An ultrasonic transducer can be positioned within plug 18.

Container 12 is placed in a handling packing 24 which can be coupled to enclosure 10 facing the lock chamber means 14, e.g. by using a bayonet fixing ring 26. During transportation, container 12 is located within packing 24 and the latter is closed on the side of ring 26 by a cover 28. Container 12 is closed on the side of cover 28 by a plug 30, equipped with a suitable gasket 32.

As is shown in the drawing, when container 12 has to be filled or emptied, packing 24 is coupled to enclosure 10 by means of ring 26. Covers 22 and 28 are then open and container 12 is brought into the lock chamber means 14 and fixed into the ferrule 16 by not shown means, such as screws. In this position, a joint 34 ensures a perfect seal between the end of the container surrounding plug 30 and the surface facing ferrule 16. Plug 18 and then plug 30 are then removed and the filling or emptying of the container takes place, whilst working within the contaminated enclosure.

When these operations are completed, the plug 30 of the container and then plug 18 of the lock chamber means are refitted. Due to the nature of the products contained in enclosure 10 and container 12, it is obvious that the cavity C defined between plugs 18 and 30 is contaminated. As the air contained in this cavity can come into contact with the outer surfaces of the enclosure or container during the uncoupling operation, it is necessary to decontaminate cavity C.

Initially, it is possible to carry out this decontamination by circulating ultrasonically stirred freon in said cavity and in accordance with French Pat. No. 2,352,377 of May 21st 1976. However, following this operation, there is a residual contamination of the walls of cavity C, which may lead to a dispersion of toxic dust during the uncoupling operation. Although this dispersion may be tolerable from the standpoint of the generally accepted atmospheric contamination criteria, it is still desirable to prevent it.

To this end, and in accordance with the invention, besides the ultrasonically stirred freon decontamination means (not shown in the drawing in order to facilitate the understanding of the invention), means are provided making it possible to remotely deposit a film of a product which fixes the toxic dust to the walls of cavity C.

These means comprise at least one inlet pipe 36 and at least one outlet pipe 38 traversing ferrule 16 and issuing into cavity C. In order to bring about the remote deposition of the toxic dust fixing product on surface $S_1$ of plug 18 and on surface $S_2$ of plug 30, this product is dissolved in a solvent able to wet the walls of cavity C. The thus obtained solution is then injected through pipe 36 into cavity C after sealing the outlet pipe 38. The solvent is vaporized, so as to fix part of the product introduced in solution into cavity C on the wall of the latter and particularly on surfaces $S_1$ and $S_2$. Vaporization can be carried out either by circulating air in the cavity, or by producing a vacuum.

The product used for fixing the toxic dust to the walls can be a silicone grease. Thus, this product has the double advantage of easily adhering to the surfaces and being able to resist temperatures above 150° C. It is also possible to use a cellulose paint.

The solvent could be formed by freon or by any other organic solvent, constituting a wetting agent, whose boiling temperature is between 0° and 70° C. Among these other solvents, reference can be particularly made to trichloroethylene, chlorinated derivatives of acetone and ether. The use of freon is justified in the present case, due to the fact that it contains neutrophage chlorine and it is also inert. Moreover, it forms a good wetting agent and has a very low boiling temperature (45° C.) and a vapour tension of approximately 0.4 bar at 20° C., which makes it possible to easily vaporize it without heating.

As the complete circuit constituted by pipes 36 and 38 and by cavity C define a volume of approximately 0.5 liters, in exemplified manner 200 g of silicone grease dissolved in 1.5 liters of freon are used. As a result of this process, a regular silicone grease film is formed, with a thickness between 0.3 and 1 mm. The regularity and thickness of this film make it possible to fix substantially all the dust contaminating the walls of cavity C.

When the container 12 is then coupled to another enclosure, surface $S_2$ of the plug is cleaned by filling cavity C with freon and discharging the thus obtained solution before opening the plugs. Surface $S_1$ of the enclosure is cleaned in the same way, when another container is coupled to enclosure 10.

Obviously, the invention is not limited to the embodiment described and in fact covers all variants thereof. In particular, the invention is applicable to any remote coating of the surfaces of a cavity with the aid of a product adhering to these surfaces.

What is claimed is:

1. A method for remotely fixing toxic dust on the surfaces of a sealed cavity defined between the plugs of two plugged enclosures sealingly coupled to each other around said plugs, comprising:

(a) filling said cavity through at least one inlet zone to said cavity with a solution of silicone grease in a solvent capable of wetting the surface of said cavity, (b) vaporizing said solvent in said cavity, and (c) evacuating said solvent from said cavity, whereby the surfaces of said cavity are coated with said silicone grease thereby fixing said toxic dust thereto prior to uncoupling of said plugged enclosures.

2. The method of claim 1 wherein said solvent is vaporized by producing a vacuum within said cavity.

3. The method of claim 1 wherein said solvent is vaporized by circulating air within said cavity.

4. The method of claim 1 wherein said solvent is freon.

* * * * *